US007052099B2

(12) United States Patent
Usuda et al.

(10) Patent No.: US 7,052,099 B2
(45) Date of Patent: May 30, 2006

(54) LIQUID DROP EJECTING DEVICE AND LIQUID DROP EJECTING METHOD, LAYER FORMING DEVICE AND LAYER FORMING METHOD, MANUFACTURING FOR DEVICE, AND ELECTRONIC APPARATUS

(75) Inventors: Hidenori Usuda, Matsumoto (JP); Shinichi Nakamura, Okaya (JP); Yutaka Takano, Ashi-mura (JP); Yoshiaki Yamada, Shinoshuwa-machi (JP)

(73) Assignee: Seiko Epson Corporation (JP)

( * ) Notice: Subject to any disclaimer, the term of this patent is extended or adjusted under 35 U.S.C. 154(b) by 225 days.

(21) Appl. No.: 10/658,108

(22) Filed: Sep. 9, 2003

(65) Prior Publication Data

US 2004/0125159 A1 Jul. 1, 2004

(30) Foreign Application Priority Data

Sep. 11, 2002 (JP) ..... 2002-265736
Aug. 4, 2003 (JP) ..... 2003-285988

(51) Int. Cl.
*B41J 29/38* (2006.01)

(52) U.S. Cl. ..... 347/10; 347/14

(58) Field of Classification Search ..... 347/10–11, 347/6, 142, 148, 14, 15, 100
See application file for complete search history.

(56) References Cited

U.S. PATENT DOCUMENTS 5,975,668 A * 11/1999 Fujii et al. ..... 347/10
6,059,392 A * 5/2000 Park ..... 347/8
6,428,151 B1 * 8/2002 Yi et al. ..... 347/68
6,563,527 B1 * 5/2003 Shimoda et al. ..... 347/240

FOREIGN PATENT DOCUMENTS

| | | |
|---|---|---|
| JP | 5-177833 | 7/1993 |
| JP | 06-023983 | 2/1994 |
| JP | 06-297725 | 10/1994 |
| JP | 07-047672 | 2/1995 |
| JP | 08-318621 | 12/1996 |
| JP | 10-258504 | 9/1998 |
| JP | 2001-277658 | 9/2001 |
| JP | 2002-079696 | 3/2002 |
| JP | 2002-137373 | 5/2002 |
| JP | 2002-154208 | 5/2002 |
| JP | 2002-187270 | 7/2002 |

OTHER PUBLICATIONS

Communication from Japanese Patent Office re: counterpart application and translation.
Communication from Japanese Patent Office re: counterpart application and translation.

* cited by examiner

*Primary Examiner*—Lamson Nguyen
(74) *Attorney, Agent, or Firm*—Harness, Dickey & Pierce, P.L.C.

(57) ABSTRACT

A liquid drop ejecting device is provided with liquid drop ejecting heads having different specifications from each other and plural dummy load circuits which apply electric loads to the liquid drop ejecting heads, and analogue switches for switching the dummy load circuit which is connected to the liquid drop ejecting heads according to the liquid drop ejecting head to be driven. By doing this, it is possible to provide a liquid drop ejecting device and a method therefor, a layer forming device and a method for forming a layer, a method for manufacturing a device, and an electronic apparatus without deteriorating a quality of the printed image.

16 Claims, 12 Drawing Sheets

LIQUID DROP EJECTING DEVICE AND LIQUID DROP EJECTING METHOD, LAYER FORMING DEVICE AND LAYER FORMING METHOD, MANUFACTURING FOR DEVICE, AND ELECTRONIC APPARATUS

BACKGROUND OF THE INVENTION

1. Field of the Invention

The present invention relates to a liquid drop ejecting device which ejects a functional liquid by a liquid drop ejecting head to a workpiece such as a substrate and to a method therefor, a layer forming device and a method for forming a layer, a method for manufacturing the device, and an electronic apparatus.

2. Description of Related Art

In a liquid drop ejecting device, such as an ink jet printer, which can perform a color printing operation, a plurality of liquid drop ejecting heads are disposed in a carriage A different color ink (liquid drop) is charged into each of the liquid drop ejecting devices. In a liquid drop ejecting device having such a structure, a printing operation is performed such that each head is driven separately according to printing data so as to control the liquid drop ejection for each color. There has been provided a liquid drop ejecting device which is provided with a plurality of liquid drop ejecting heads, and the liquid drop ejecting heads which are disposed in such a liquid drop ejecting device are the same as each other. A document such as Japanese Unexamined Patent Application, First Publication No. 2001-277658 discloses details of the liquid drop ejecting device which is provided with a plurality of liquid drop ejecting heads.

Here, there is a case in which it is necessary to eject a plurality of liquid drops having different viscosities to a workpiece on which a plurality of functional liquids must be formed. For such a case, it is possible to mention a case in which a preparation which does not need a cover glass is manufactured by applying a staining material on a sample on a preparation so as to fix the sample by a coating material. In this technique, it is necessary to eject a low viscosity sample staining material (functional liquid) and a high viscosity coating material (functional liquid) by the liquid drop ejecting head.

It is necessary to use different functional liquid heads which have different specifications according to which of the low viscosity sample staining material or the high viscosity coating material is ejected. Therefore, basically, it is necessary to use two liquid drop ejecting devices on each of which liquid drop ejecting heads having different specifications are mounted. Alternatively, it is necessary to replace a liquid drop ejecting head (containing a functional liquid supplying system) which a liquid drop ejecting device appropriately.

However, when the former liquid drop ejecting device is used, it takes time to transport a workpiece to the other liquid drop ejecting device. When the latter liquid drop ejecting device is used, it takes time to exchange the liquid drop ejecting head. Therefore, the overall process for ejecting liquid drop to the workpiece becomes quite complicated. In order to solve such a problem, it is preferable that different liquid drop ejecting heads having different specifications from each other be disposed in a liquid drop ejecting device, and a common driving circuit for these liquid drop ejecting heads be disposed so as to simplify the structure in the device.

A dummy load circuit is disposed in a driving circuit in the liquid drop ejecting head so as to prevent a deterioration of a printed image which is caused by a floating capacity. An optimal figure of the dummy load depends on the specification of the liquid drop ejecting head. When liquid drop ejecting heads having different specifications from each other are driven by a common driving circuit as in the above case, it sometimes occurs that it is not possible to set an optimal dummy load in some types of the liquid drop ejecting heads. Thus, there is a problem in that the quality of the printed image will be deteriorated.

SUMMARY OF THE INVENTION

The present invention was made in consideration of the above problems. An object of the present invention is to provide a liquid drop ejecting device which can perform efficient operations on workpieces by ejecting various functional liquid drops and a method therefor, a layer forming device and a method for forming a layer, a method for manufacturing a device, and an electronic apparatus.

In order to solve the above problem, a liquid drop ejecting device for ejecting a liquid drop to a workpiece according to a first aspect of the present invention comprises a plurality of liquid drop ejecting heads, a plurality of control sections which are provided with circuits for restricting an oscillation of a driving waveform which is applied to the liquid drop ejecting heads, and a selecting section which selects either one of the plurality of control sections according to a liquid drop which is ejected from the liquid drop ejecting heads. In this aspect of the present invention, it is preferable that the driving waveform be applied to the liquid drop ejecting heads via the control section which is selected by the selecting section.

According to this aspect of the present invention, the control section is selected according to the ejected liquid drop, and the driving waveform is applied to the liquid drop ejecting head via the selected control section. Therefore, an optimal circuit can be selected for restricting an oscillation of the driving waveform according to the liquid drop ejecting head which is driven. Therefore, the quality of the printed image does not become deteriorated. In addition, it is possible to eject various functional liquids. Also, it is not necessary to replace the liquid drop ejecting head; therefore, it is possible to perform efficient workpiece processing.

In the present invention, it is preferable that the selecting section be provided with plurality of electric switches which are connected to the control section and the liquid drop ejecting head, and the selecting section selects either one of the plurality of the control sections which are connected to the liquid drop ejecting heads by switching a connection of the electric switch.

Also, it is preferable that the selecting section be provided with a plurality of mechanical switches for switching an electric connection condition between the control section and the liquid drop ejecting heads.

Furthermore, it is preferable that the electric switch is an analogue switch. Also, it is preferable that the mechanical switch be a DIP switch which is operated by a user.

Also, according to the first embodiment of the present invention, a liquid drop ejecting device comprises a carriage on which various liquid drop ejecting heads are mounted, a functional liquid supplying structure which supplies functional liquids to the various liquid drop ejecting heads, a moving structure which moves the various liquid drop ejecting heads via the carriage relative to the workpiece, and an ejection driving control section which controls a ejection driving operation in either one of the liquid drop ejecting heads so as to synchronize the moving structure.

In order to solve the above problem, according to a second aspect of the present invention, a liquid drop ejecting device for ejecting a liquid drop to a workpiece comprises a plurality of control sections. In this aspect of the present invention, it is preferable that the plurality of control sections be provided with a plurality of liquid drop ejecting heads having different specifications from each other and a driving device which drives the liquid drop ejecting heads which are disposed, and each head unit has a circuit for restricting an oscillation of a driving waveform which is selected according to an electric characteristic in the liquid drop ejecting head.

According to this aspect of the present invention, a head unit comprises a liquid drop ejecting head and a circuit for restricting an oscillation of the driving waveform which is selected according to an electric characteristic in the liquid drop ejecting head. Also, the head unit can be exchanged in the driving device. Thus, the liquid drop ejecting head and the circuit for restricting the oscillation of the driving waveform are connected to the driving device only by replacing (attaching) the head unit; thus it is possible to eject the liquid drop without causing a deterioration in the quality of the printed image. Also, it is possible to connect the head unit which has the different liquid drop ejecting heads having different characteristics to a common driving device; thus, it is possible to reduce the cost for the device.

In the first and the second aspects in the present invention, it is preferable that the control section contain an electric resistor element and an electric capacity element.

In order to solve the above problem, a method for ejecting a liquid drop to a workpiece comprises the steps for selecting a liquid drop ejecting head which should be driven among a plurality of the liquid drop ejecting heads having different specification each other, selecting a control section among a plurality of control sections which have circuits for restricting an oscillation of the driving waveform which is applied to the liquid drop ejecting heads according to the liquid drop which is ejected from the liquid drop ejecting heads, and supplying a driving signal to the liquid drop ejecting head which is selected in the step for selecting the liquid drop ejecting head via the control section which is selected in the step for selecting the control section so as to eject the liquid drop.

In order to solve the above problem, a method for ejecting a liquid drop to a workpiece according to the second aspect of the present invention comprises the steps for mounting a head unit which is provided with a liquid drop ejecting head and a control section for restricting an oscillation of a waveform which is applied to a liquid drop ejecting head according to the liquid drop ejecting head and an electric condition therein, and supplying a driving signal to the liquid drop ejecting head via the control section which is disposed in the head unit which is mounted in the step for mounting a head unit so as to eject the liquid drop.

The present invention is characterized in that a layer forming device is provided with the liquid drop ejecting device of the present invention.

The present invention is characterized in that a layer forming method comprises the step of forming a layer by ejecting a liquid drop by the liquid drop ejecting device or the method for ejecting a liquid drop according to the present invention.

According to the present invention, in a method for manufacturing a device which is provided with a workpiece in which functional patterns are formed in predetermined sections therein, the method comprises the step for forming the functional patterns in the workpiece by ejecting the liquid drop by the liquid drop ejecting device, or according to the liquid drop ejecting method of the present invention.

An electronic apparatus of the present invention is manufactured using any one of the above liquid drop ejecting devices or any one of the above method for ejecting liquid drop.

DETAILED DESCRIPTION OF THE INVENTION

Embodiments for the liquid drop ejecting device and a method therefor, a layer forming device and a method for forming a layer, a method for manufacturing a device, and an electronic apparatus are explained with reference to the drawings below.

FIRST EMBODIMENT

Figure 1:
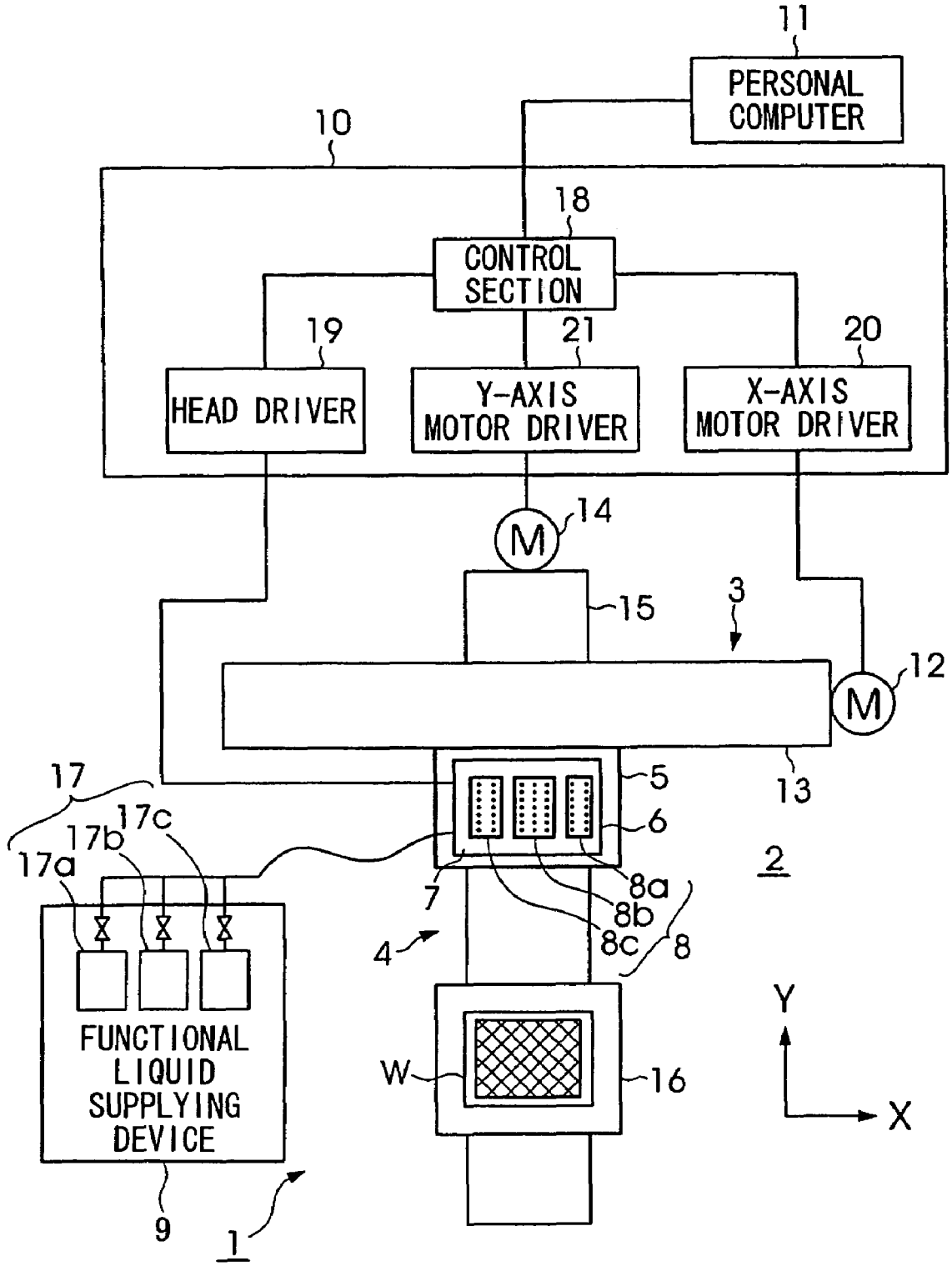
FIG. 1 is a block diagram showing a general structure of a liquid drop ejecting device according to a first embodiment of the present invention.

FIG. 1 is a block diagram showing a general structure of a liquid drop ejecting device according to a first embodiment of the present invention.

As shown in FIG. 1, a liquid drop ejecting device 1 according to the present embodiment is provided with an X-axis table 3 and a Y-axis table for moving structures which are disposed on a mount base 2. A main carriage 5 is attached on the X-axis table 3 so as to freely move thereon. A head unit 6 is disposed in the main carriage 5. Although it is explained in detail later, different liquid drop ejecting heads 8 (three heads in the present embodiment 8*a*, 8*b*, and 8*c*) having different specifications, are mounted on the head unit 6 via a sub-carriage 7. Also, a substrate W is mounted on the Y-axis table 4 as a workpiece.

Also, the liquid drop ejecting device 1 is provided with a functional liquid supplying device 9 for a functional liquid supplying structure which supplies a functional liquid to a plurality of liquid drop ejecting heads 8. Also, the liquid drop ejecting device 1 is provided with a control device 10 which controls a driving operation for the X-axis table 3, Y-axis table 4, and a plurality of different liquid drop ejecting heads 8. A personal computer 11 is connected to the control device 10 so as to generate ejection pattern data for a plurality of different liquid drop ejecting heads 8.

Here, although it is not shown in FIG. 1, the liquid drop ejecting device 1 is provided with units such as a flashing unit which receives a waste functional liquid from all ejection nozzles in the liquid drop ejecting heads 8 periodically, a wiping unit which wipes a nozzle surface in the liquid drop ejecting heads 8, and a cleaning unit which absorbs the functional liquid in the liquid drop ejecting head 8 and stores the functional liquid.

The X-axis table 3 is provided with a driving system for X-axis direction which comprises a motor 12, and X-axis slider 13 which is driven by the motor 12. Furthermore, the X-axis table 3 is provided with a main carriage 5 such that the main carriage moves freely. Also, the Y-axis table 4 is provided with a driving system form Y-axis direction which comprises a motor 14 and a Y-axis slider 15 which is driven by the motor 14. Furthermore, the Y-axis table 4 is provided with an attracting set table 16 such that the set table 16 moves freely. Furthermore, a substrate W is supported such that the substrate W is positioned on the set table 16.

The liquid drop ejecting device 1 according to the present embodiment drives (ejects the functional liquid selectively) each liquid drop ejecting head 8 so as to be synchronized with a movement of the liquid drop ejecting head 8 which is driven by the X-axis table 3. That is, a scanning operation by the liquid drop ejecting heads 8 is performed in a reciprocating manner by the X-axis table 3 in an X-axis direction. Also correspondingly, a sub-scanning operation is performed in a reciprocating movement of the substrate W by the Y-axis table 4 in a Y-axis direction. Consequently, the liquid drop ejecting heads 8 are driven according to an ejection pattern data which is produced in the above personal computer 11 so as to be synchronized with the above scanning operation.

A functional liquid supplying device 9 is provided with three sub-tanks 17 (17*a*, 17*b*, and 17*c*) which correspond to liquid drop ejecting heads 8, three main tanks which are connected to the sub-tanks 17, and a pressurized liquid transmitting device (not shown in the drawing) which transmits the functional liquid contained in the three main tanks to the corresponding sub-tanks 17. The functional liquid contained in the main tanks is transmitted to a first sub-tank 17*a*, a second sub-tank 17*b*, and a third sub-tank 17*c* correspondingly in a pressurized manner. The functional liquid which is no longer pressurized in the sub-tanks 17 is transmitted to the liquid drop ejecting heads 8 by a pumping effect by the corresponding liquid drop ejecting heads 8. Although it is not shown in the drawing, the above pressurized liquid transmitting device is controlled by the above control device 10.

Figure 2:
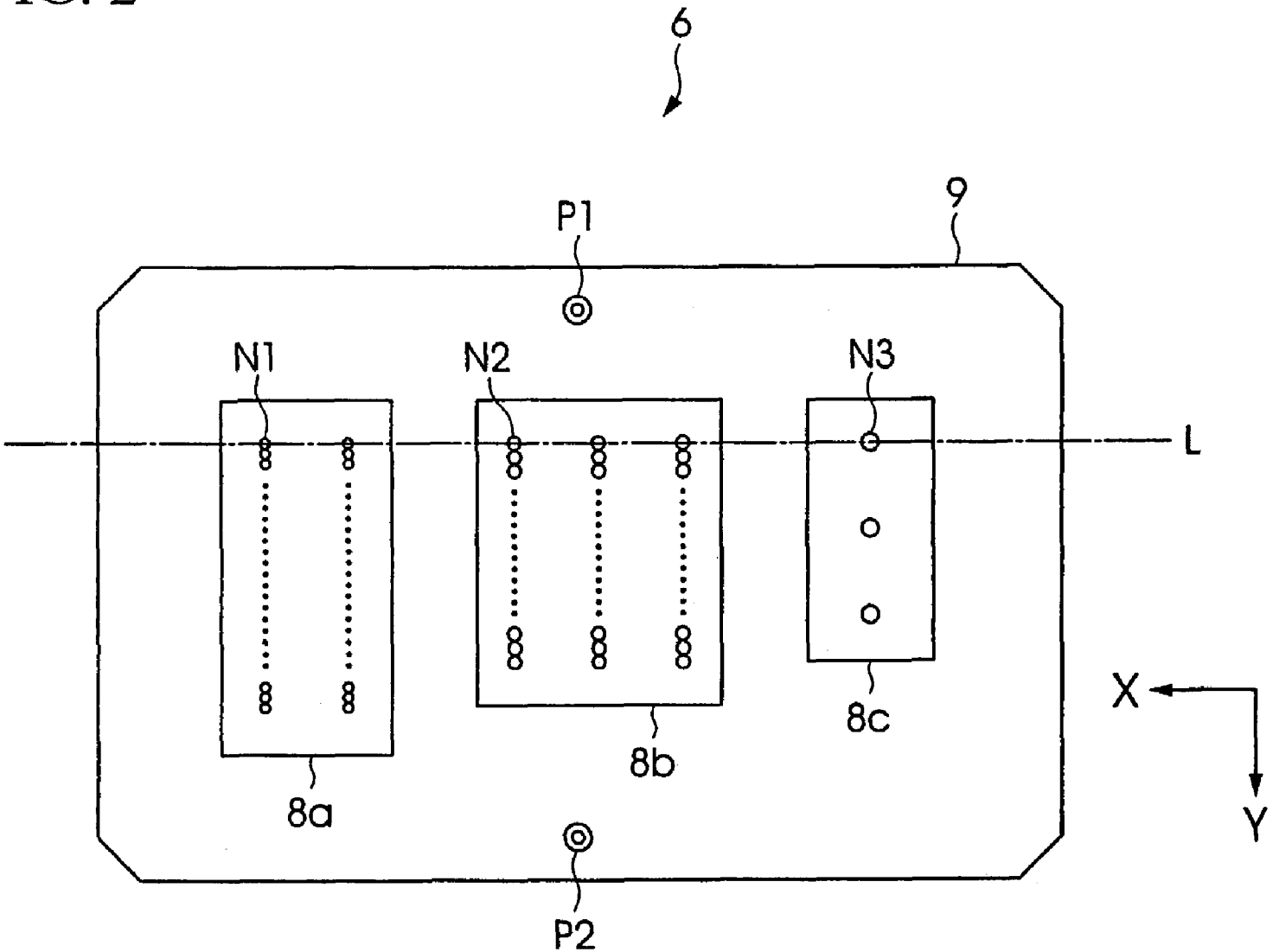
FIG. 2 is a view of a head unit which is provided to the liquid drop ejecting device according to the first embodiment of the present invention.

Here, a structure in the head unit 6 which is provided in the liquid drop ejecting device according to the present embodiment is explained. FIG. 2 is a view showing a structure of the head unit 6 which is provided in the liquid drop ejecting device according to the first embodiment of the present invention. As shown in FIG. 2, the head unit 6 comprises a sub-carriage 9 which is made of a plate made of a metal such as stainless steel and three liquid drop ejecting heads 8 which are positioned and fixed accurately on the sub-carriage 9.

As shown in FIG. 2, the liquid drop ejecting heads 8 comprises a first ejecting head 8*a*, a second ejecting head 8*b*, and a third ejecting head 8*c*. Here, ejecting nozzles which are positioned outermost of the first ejecting head 8*a* to the third ejecting head 8*c* are called as reference nozzles N1 to N3. The ejecting nozzles are disposed in the first ejecting head 8*a* to the third ejecting head 8*c* in a sub-scanning direction (Y-axis direction) such that the reference nozzles N1 to N3 are disposed on a virtual line L which is parallel with a main scanning direction (X-axis direction). Also, a pair of positioning reference pins P1 and P2 are disposed at both ends in the Y-axis direction in a middle of the sub-carriage 9 in the Y-axis direction.

For example, the above reference nozzles N1 to N3 are used for compensating (for ejection pattern data) for an ejection receiving position between nozzle arrays in the first ejection head 8*a*. Also, the above reference nozzles N1 to N3 are used for a positioning reference in a compensating operation for an ejection receiving position between the first ejection head 8*a* and the second ejection head 8*b*, or between the second ejection head 8*b* and the third ejection head 8*c*. Also, the ejection heads 8*a*, 8*b*, and 8*c* are positioned and fixed on the sub-carriage 9 according to the reference nozzles N1 to N3. On the other hand, the above pair of the reference pins P1 and P2 are used for reference points to position the head unit 6.

Specifications in the three liquid drop ejecting heads 8 (the first ejecting head 8*a* to the third ejection head 8*c*) are different from each other. For example, in the first ejection head 8*a*, two nozzle arrays are disposed in which 180 nozzles are disposed. In the second ejection head 8*b*, three nozzle arrays are disposed in which 96 nozzles are disposed. In the third ejection head 8*c*, a nozzle array is disposed in which three nozzles are disposed.

Figure 3:
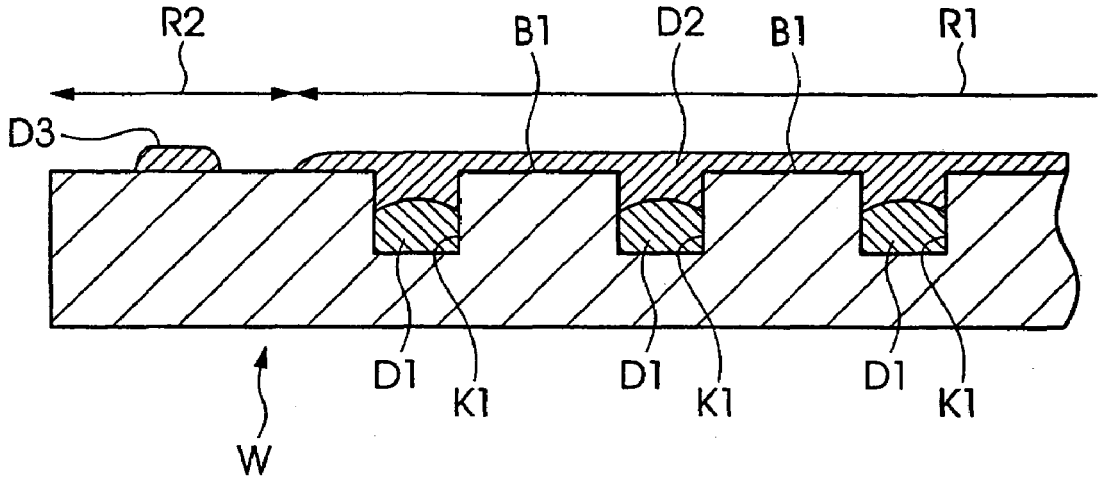
FIG. 3 is a view showing a first example for processing a substrate by the liquid drop ejecting device according to the first embodiment of the present invention.

As explained above, plural different liquid drop ejecting heads are provided so as to eject a plurality of different liquid drops to the substrate W while changing the liquid drop amount (weight, volume). Here, a processing operation for a substrate by the liquid drop ejecting device is explained. FIG. 3 is a view showing a first example for processing a substrate by the liquid drop ejecting device according to the first embodiment of the present invention.

As shown in FIG. 3, explanation is made under condition that a volatile first functional liquid D1 is ejected in concave sections K1 on the substrate W as a workpiece on which a matrix contouring area R1 in which a bank B1 is formed, a second functional liquid D2 is ejected for overcoating an overall contouring area R1 so as to eject the first functional liquid D1 in the concave sections K1. Furthermore, when a defective ejection occurs in the first functional liquid D1 and the second functional liquid D2, a defect mark is marked in a marking area R2 on the substrate W by a third functional liquid D3 so as to indicate a defect thereon.

In this case, for example, the first functional liquid D1 is introduced in the first ejection head 8*a*. The second functional liquid D2 is introduced in the second ejection head 8*b* for overcoating thereon. The third functional liquid D3 is introduced in the third ejection head 8*c* for marking. The liquid drop is ejected from the first to third, ejection heads 8*a* to 8*c* while changing a relative position between the substrate W and the liquid drop ejecting heads 8. Here, the functional liquid is used such that viscosity of the first functional liquid D1 is relatively low, and viscosity of the second functional liquid D2 is relatively high. Furthermore, the third functional liquid D3 for marking, which has approximately the same viscosity as that of the second functional liquid D2, is used.

Figure 4:
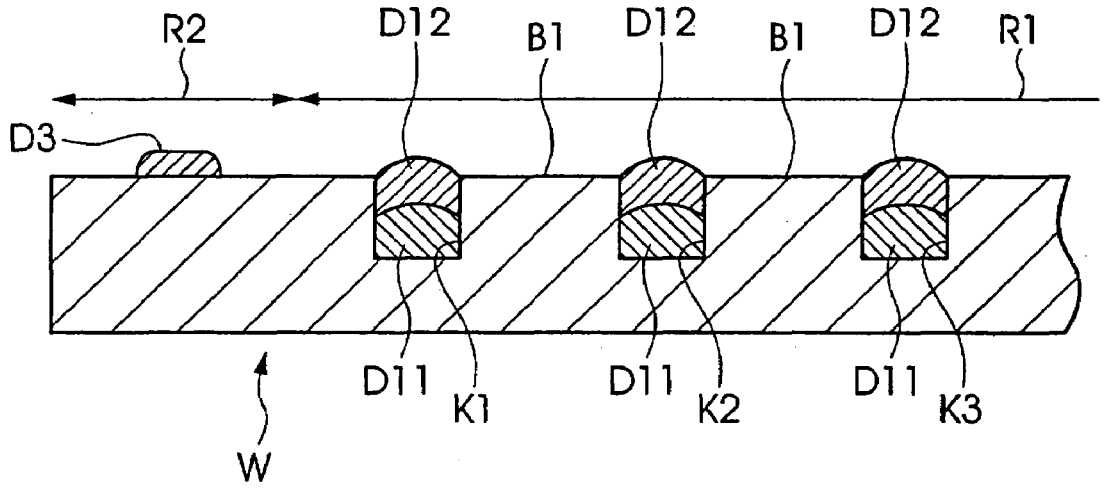
FIG. 4 is a view showing a second example for processing a substrate by the liquid drop ejecting device according to the first embodiment of the present invention.

FIG. 4 is a view showing a second example for processing a substrate by the liquid drop ejecting device according to the first embodiment of the present invention. As shown in FIG. 4, an A functional liquid (illuminating liquid) D11 and a B functional liquid (hardening liquid) D12 as a two-liquid-illuminating-functional-liquid (or a filter functional liquid for a color filter) are ejected in this order on the concave sections K1 on the substrate W as a workpiece in which a matrix contouring area R1 is disposed in which a bank B1 is formed. Consequently, similarly to the above case, a defect mark is marked in the marking area R2 by using the third functional liquid D3.

In this case, for example, the A functional liquid D11 is introduced in the first ejection head 8*a*, the B functional liquid D12 is introduced in the second ejection head 8*b*, the third functional liquid D3 is introduced in the third ejection head 8*c*. The liquid drops are ejected from the first to third ejection heads 8*a* to 8*c* while the relative position between the substrate W and the liquid drop ejecting heads 8 is changed. By doing this, it is possible to eject a plurality of fine different liquid drops accurately in a dot manner by providing a plurality of liquid drop heads. Therefore, it is possible to use such structure for manufacturing various parts in various industries if a special ink such as an illuminating or photosensitive resin is used for a functional liquid (liquid to be ejected).

Here, in examples for a substrate processing operation shown in FIGS. 3 and 4, the amount of the functional liquid per unit nozzle is small in the first ejection head 8*a*, the amount of the functional liquid per unit nozzle is large in the second ejection head 8*b*, and the amount of the functional liquid per unit nozzle is extremely large in the third ejection head 8*c*. This is because the type of the functional liquids D1 to D3 and their ejection condition are taken into consideration.

In FIG. 1, the control device 10 comprises a control section 18, a head driver 19, an X-axis motor driver 20, and a Y-axis motor driver 21 so as to control devices in the liquid drop ejecting device 1 integrally. The control section 18 is connected to a personal computer 11 so as to drive the head driver 19, the X-axis motor driver 20, and the Y-axis motor driver 21 according to a control command which is outputted from the personal computer 11. The head driver 19 drives the liquid drop ejecting heads 8 (the first to third ejection heads 8*a* to 8*c*).

Figure 5:
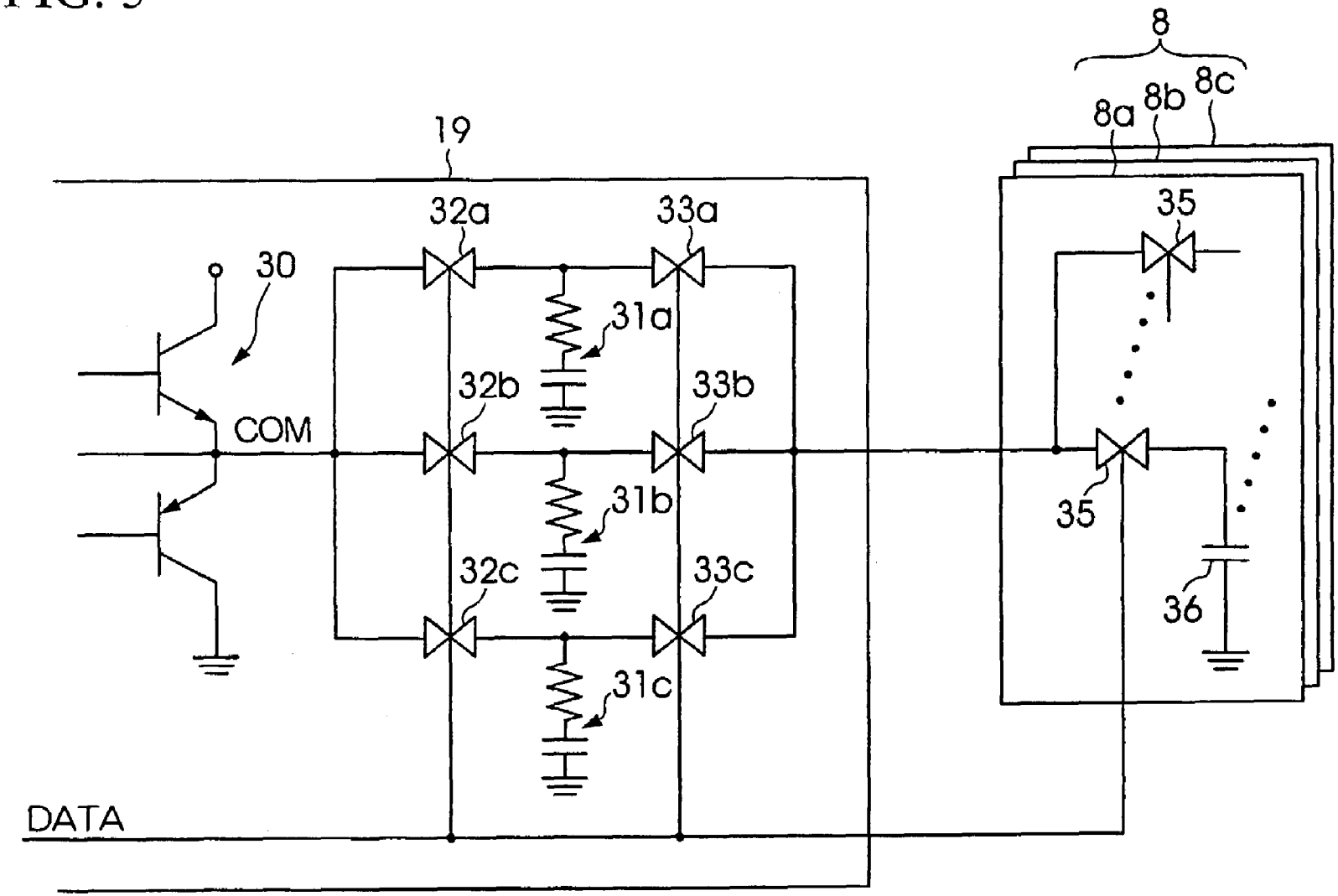
FIG. 5 is an electric diagram in a head driver and a liquid drop ejecting head which are provided in the liquid drop ejecting device according to the first embodiment of the present invention.

Here, a structure in the head driver 19 is explained. FIG. 5 is an electric diagram in a head driver and a liquid drop ejecting head which are provided in the liquid drop ejecting device according to the first embodiment of the present invention. Here, in FIG. 5, only necessary structures are shown for explaining the present invention. As shown in FIG. 5, the head driver 19 comprises an amplifier 30 for amplifying a driving waveform COM for driving the liquid drop ejecting heads 8 (the first to third ejection heads 8*a* to 8*c*), dummy load circuits 31*a* to 31*c* for controlling the dummy load, and analogue switches 32*a* to 32*c*, and 33*a* to 33*c*.

In the dummy load circuit 31*a*, an electric resistor and a condenser are connected in series. The resistance and capacity in the dummy load circuit 31*a* are set according to electric characteristics in the first to third ejection heads 8*a* to 8*c*. Analogue switches 32*a* to 32*c*, and 33*a* to 33*c* are electric switches which open and close according to a print data DATA. The analogue switches 32*a* to 32*c*, and 33*a* to 33*c* serve as a switching section in the present invention.

A circuit in which the analogue switches 32*a* and 33*a* are connected in series, a circuit in which the analogue switches 32*b* and 33*b* are connected in series, and a circuit in which the analogue switches 32*c* and 33*c* are connected in series are connected in parallel. The amplifier 30 and the liquid drop ejecting heads (the first to third ejection heads 8*a* to 8*c*) are connected. Here, the dummy load circuit 31*a* is connected to the analogue switches 32*a* and 33*a*. The dummy load circuit 31*b* is connected to the analogue switches 32*b* and 33*b*. The dummy load circuit 31*c* is connected to the analogue switches 32*c* and 33*c*.

The liquid drop ejecting heads (the first to third ejection heads 8*a* to 8*c*) are provided with the same number of analogue switches 35 as that of the ejection nozzles and a pressure generating element 36 such as a piezo-element. All the analogue switches 35 are connected to the analogue switches 33*a* to 33*c* which are disposed in the head driver 19 so as to supply the driving waveform COM to the pressure generating element 36 via the dummy load circuits 31*a* to 31*c*.

Also, print data DATA is supplied to each of analogue switches 35. The analogue switches are controlled so as to open and close according to the print data DATA. For example, "1 (one)" is supplied as a print data DATA, the analogue switch 35 is opened. In this case, the driving waveform COM which is sent via the dummy load circuits 31*a* to 31*c* is supplied to the pressure generating element 36 via the opening analogue switch 35; thus, a liquid drop is ejected from the pressure generating element 36.

As explained above, the print data DATA is supplied to all of the analogue switches 35 which are provided in the liquid drop ejecting heads 8 (the first to third the first to third ejection heads 8*a* to 8*c*); therefore, it is possible to select the liquid drop ejecting heads 8 (the first to third the first to third ejection heads 8*a* to 8*c*) according to the print data DATA. Also, the print data DATA is supplied to the above analogue switches 32*a* to 32*c*, and 33*a* to 33*c*.

The opening and closing condition of the analogue switches 32*a* to 32*c*, and 33*a* to 33*c* are set independently according to the print data DATA. Therefore, by opening either one (a pair) of the analogue switches 32*a* and 33*a*, analogue switches 32*b* and 33*b*, and analogue switches 32*c* and 33*c*, it is possible to connect only one of the dummy load circuits 31*a* to 31*c* to the liquid drop ejecting heads 8.

Also, it is possible to connect a plurality of dummy load circuits 31*a* to 31*c* to the liquid drop ejecting devices 8 by opening a plurality of (pairs of) analogue switches 32*a* and 33*a*, analogue switches 32*b* and 33*b*, and analogue switches 32*c* and 33*c*. By doing this, when a plurality of dummy circuits 31*a* to 31*c* are connected to the liquid drop ejecting devices 8, it is possible to connect an electric resistance which is other than the electric resistance (dummy load circuits 31*a* to 31*c*) which are prepared in advance to the liquid drop ejecting heads 8. Therefore, it is possible to eject the liquid drops stably even when a load in the liquid drop ejecting heads 8 varies.

Ordinarily, print data DATA is used for controlling a pressure generating operation in the pressure generating element 36 so as to control the ejection of the liquid drops. In the present embodiment, the print data DATA is also used for selecting the liquid drop ejecting heads 8 to be driven and switching the dummy load circuits 31*a* to 31*c* which are connected to the liquid drop ejecting heads 8. More importantly, it should be understood that a switching operation between the liquid drop ejecting heads 8 and the dummy load circuits 31*a* and 31*b* is not performed according to the print data DATA while the liquid drop is ejected.

In the above structure, a control signal which selects the liquid drop ejecting heads 8 is outputted from the control section 18 to the head driver 19 before the liquid drop is ejected to the substrate W. The head driver 19 outputs print data DATA which indicates a selection of the liquid drop ejecting heads 8 (either one of the first to third ejection heads 8*a* to 8*c*). When the print data DATA is outputted, the liquid drop ejecting head to be driven is selected (a head selecting step). Here, it should be understood that a first ejection head 8*a* is selected.

After the liquid drop ejecting head is selected, the head driver 19 outputs (a dummy load selecting step) print data DATA which indicates a selection (switching) of the dummy load circuit which should be connected to the selected liquid drop ejecting head according to the control signal which is outputted from the control section 18. Either one or a plurality of the analogue switches 32*a*, and 33*a*, the analogue switches 32*b* and 33*b*, the analogue switches 32*c* and 33*c* are opened according to the print data DATA; thus, at least one of the dummy load circuits 31*a* to 31*c* are connected to the selected liquid drop ejecting head electrically.

After the liquid drop ejecting head and the dummy load circuit are selected, for example, as shown in FIG. 3, the head unit 6 is scanned in the X direction by driving the motor 12 so as to perform substrate processes; thus, the driving waveform COM is supplied to the first ejection head 8*a* via the selected dummy load circuit. By doing this, the first functional liquid D1 is ejected to the concave sections K1 (driving step). Consequently, the liquid drop ejecting head 8 and the dummy load circuit are selected by the print data DATA according to the control signal which is outputted from the control section 18 similarly as above. Here, it should be understood that the second ejection head 8*b* is selected. After the selection of the ejection head, the second functional liquid D2 is ejected to the contouring area R1 by the second ejection head 8*b* such that the functional liquid is applied roughly and densely.

Also, in a substrate processing as shown in FIG. 4, the first ejection head 8*a* is scanned (scanning operation) before the second ejection head 8*b* is scanned when the head unit 6 is scanned. The A functional liquid D11 is ejected to each concave section K1 by the first ejection head 8*a*. Immediately after that, the B functional liquid drop D12 is ejected on the A functional liquid drop D11 by the second ejecting head 8*b*. Here, a third ejecting head 8*c* for contouring a marking acknowledges a missing dot as an image by a substrate acknowledging camera, which is not shown in the drawing, after the above substrate processing operation; thus, the third ejecting head 8*c* for contouring a mark is appropriately driven according to the acknowledgment result. The third ejecting head 8*c* performs a marking operation so as to acknowledge the mark as an image so as to identify the defective products. By using the third ejecting head 8*c* which ejects extremely large amounts of the functional liquid, it is possible to contour a mark in a short period of time.

As explained above, in the first embodiment of the present invention, an optimal dummy load is selected according to the selected liquid drop ejecting head. Also, the driving waveform COM is supplied to the liquid drop ejecting head via the dummy load. Therefore, it is possible to eject various functional liquid drops without causing a deterioration in a quality of the printed image such as non-uniform ejection. As a result of this, it is possible to perform the substrate processing operation efficiently. In particular, in the substrate processing operation shown in FIG. 3, it is possible to seal the first volatile functional liquid drop D1 by the second functional liquid drop D2 before the first volatile functional liquid drop D1 evaporates. Also, as shown in an example in the FIG. 4, it is possible to mix (two) functional liquid drops such as the A functional liquid drop D11 and the B functional liquid drop D12 in a short period of time.

The liquid drop ejecting device according to the first embodiment of the present invention is explained as above. In the above embodiment, explanations are made for a case in which an analogue switch is disposed for an electric switch. More importantly, it should be understood that the present invention is not limited to an analogue switch, and an electric switch such as a transistor or a FET (ferroelectric transistor) may be acceptable in the present invention.

SECOND EMBODIMENT

Figure 6:
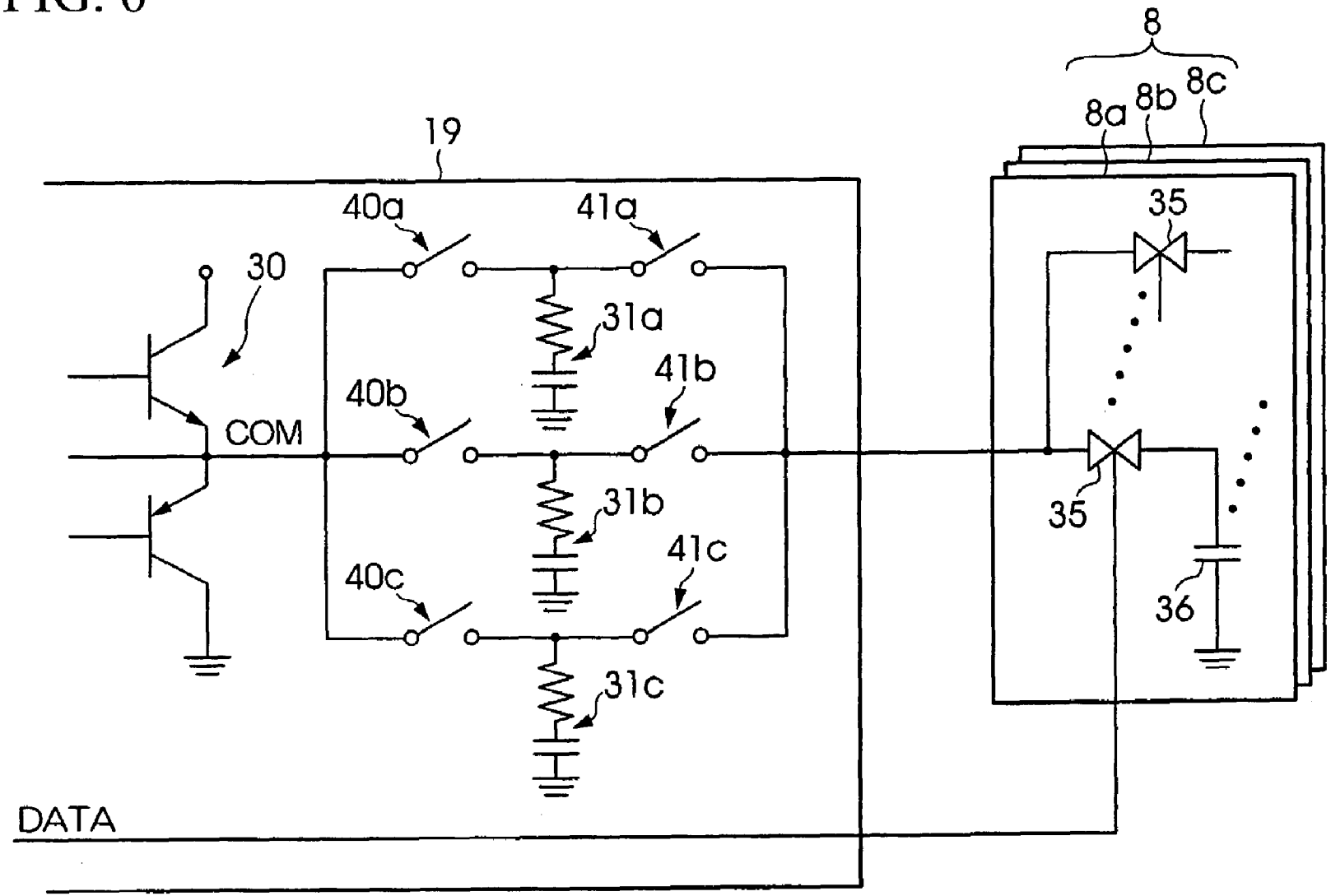
FIG. 6 is an electric diagram in a head driver and a liquid drop ejecting head which are provided in the liquid drop ejecting device according to a second embodiment of the present invention.

Next, a liquid drop ejecting device according to a second embodiment of the present invention is explained. FIG. 6 is an electric diagram in a head driver and a liquid drop ejecting head which are provided in the liquid drop ejecting device according to a second embodiment of the present invention. Here, only necessary features are described for explaining the present invention in FIG. 6 similar to the case of FIG. 5. Also, the overall structure for the liquid drop ejecting device and the liquid drop ejecting head according to the second embodiment is similar to those shown in FIGS. 1 and 2; thus, explanations of such structure are omitted.

A head driver 19 shown in FIG. 6 which is disposed in a liquid drop ejecting device according to a second embodiment of the present invention is different from the head driver shown in FIG. 5 which is disposed in a liquid drop ejecting device according to the first embodiment of the present invention in that analogue switches 32*a* to 32*c*, and analogue switches 33*a* to 33*c* shown in FIG. 5 are replaced by DIP switches (Dual In-line Pin Switches) 40*a* to 40*c*, and 41*a* to 41*c*. The DIP switches 40*a* to 40*c*, and 41*a* to 41*c*, are equivalent to a mechanical switch in the present invention. These DIP switches are turned on and turned off by an operation by a user. By turning on or off these DIP switches 40*a* to 40*c*, and 41*a* to 41*c*, it is possible to select the dummy load which is connected to the liquid drop ejecting head.

In the above structure, the user operates one (a pair of) DIP switches or a plurality of (plural pairs of DIP switches so as to select (dummy load selecting step) the dummy load which is connected to the liquid drop ejecting head 8 before the liquid drop is ejected to the substrate W. Next, a control signal for selecting the liquid drop ejecting head 8 is outputted to the head driver 19 from the control section 18. Here, the control signal indicates a selection of the liquid drop ejecting head 8 which is appropriate for the dummy load which is selected in the above step. In other words, the user determines which liquid drop ejecting head to select in advance and selects the dummy load which is appropriate for the liquid drop ejecting head 8 by operating the DIP switch; thus, the control signal which selects the liquid drop ejecting head 8 which is determined in advance is outputted from the control section 18.

The head driver 19 outputs a print data DATA which indicates a selection of the liquid drop ejecting heads 8 (either one of the first to third ejection heads 8*a* to 8*c*) according to the control signal. When the print data DATA is outputted, the liquid drop ejecting head to be driven is selected (a head selecting step). Here, it should be understood that a first ejection head 8*a* is selected.

After the liquid drop ejecting head which should be selected is selected, as similarly to a case of the first embodiment, as shown in FIG. 3, the head unit 6 is scanned in the X direction by driving the motor 12 so as to perform a substrate processes; thus, the driving waveform COM is supplied to the first ejection head 8*a* via the selected dummy load circuit. By doing this, the first functional liquid D1 is ejected to the concave sections K1 (driving step). Consequently, the liquid drop ejecting head 8 and the dummy load circuit are selected by the print data DATA according to the control signal which is outputted from the control section 18, similarly as above. Here, it should be understood that the second ejection head 8*b* is selected. After the selection of the ejection head, the second functional liquid D2 is ejected to the contouring area R1 by the second ejection head 8*b* such that the functional liquid is applied roughly and densely.

Also, in a substrate processing as shown in FIG. 4, the first ejection head 8*a* is scanned (scanning operation) before the second ejection head 8*b* is scanned (only one direction scanning operation) when the head unit 6 is scanned. The A functional liquid D11 is ejected to each concave section K1 by the first ejection head 8*a*. Immediately after that, the B functional liquid drop D12 is ejected on the A functional liquid drop D11 by the second ejecting head 8*b*. By doing this, an optimal dummy load is connected to the liquid drop ejecting heads 8 (either one of the first to third ejection heads 8*a* to 8*c*); thus, the liquid drop is ejected stably.

The liquid drop ejecting device according to the second embodiment of the present invention is explained as above. In the above embodiment, explanations are made for a case in which a DIP switch is used for a mechanical switch. However, the present invention is not limited only to the DIP switch. The present invention can use any material as long as such a mechanical switch can switch an electric connection condition between the dummy load circuit and the liquid drop ejecting head. Also, in the above embodiment, explanations are made for a case in which the user operates the DIP switch manually. However, it is more important to understand that it is acceptable that the mechanical switch be turned on and turned off by using a motor or an actuator.

THIRD EMBODIMENT

Figure 7:
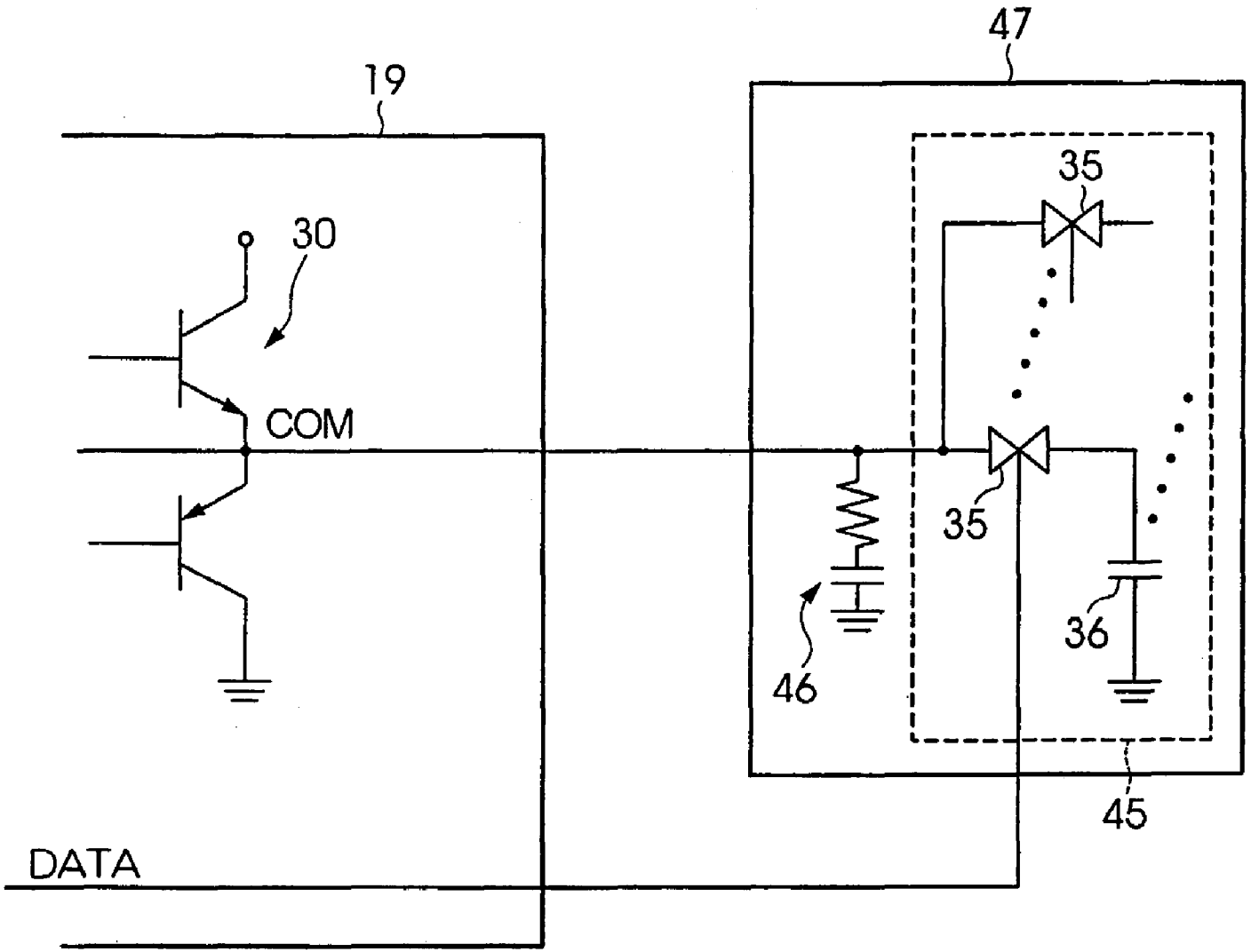
FIG. 7 is an electric diagram in a head driver and a liquid drop ejecting head which are provided in the liquid drop ejecting device according to a third embodiment of the present invention.

Next, a liquid drop ejecting device according to a third embodiment of the present invention is explained. FIG. 7 is an electric diagram in a head driver and a liquid drop ejecting head which are provided in the liquid drop ejecting device according to a third embodiment of the present invention. Here, only necessary features are described for explaining the present invention in FIG. 7 as similar to a case of FIG. 6.

In the first and second embodiments which are explained as above, a plurality of various liquid drop ejecting heads 8 (8*a*, 8*b*, and 8*c*) having different specifications from each other are mounted on the head unit 6. Also, the dummy loads 31*a* to 31*c* are disposed on the head driver 19; thus, the dummy load which is connected is selected by the analogue switches 32*a* to 32*c*, and 33*a* to 33*c*, or by the DIP switches 40*a* to 40*c*, and 41*a* to 41*c*, according to the liquid drop ejecting head which should be driven.

In contrast, in the present embodiment, the dummy load circuit and the analogue switches are omitted in the head driver 19. Instead, a liquid drop ejecting head 45 which comprises the same quantity of analogue switch 35 as the quantity of the ejection nozzles and a pressure generating element 36 such as a piezo-element and a head unit 47 which is provided with a dummy load circuit 46 are connected to the head driver 19. Specifications in the liquid drop ejecting heads 45 which are provided in the head unit 47 are different from each other. The specification in the dummy circuit 46 is equivalent to that in the liquid drop ejecting head 45.

As explained above, in the present embodiment, the dummy load circuit 46 having a corresponding specification to that in the liquid drop ejecting head 45 is disposed in the head unit 47 such that the head unit 47 is provided with the liquid drop ejecting head 45 which should be driven; thus, the liquid drop ejecting head 45 and the head driver 19 are electrically connected. By doing this, an optimal dummy load circuit 46 which is suitable for the liquid drop ejecting head 45 is connected in the middle of the head driver 19 and the liquid drop ejecting head 45 only by mounting the liquid drop ejecting head 45 which is selected by the user; thus, it is possible to eject the liquid drop stably.

In the above structure, the user selects which head unit 47 to be attached according to an ejection quantity of the liquid drop so as to mount (head unit mounting step) the head unit 47 on the main carriage 5 (see FIG. 1) before the liquid drop is ejected to the substrate W. By performing such operations, the head driver 19 is connected to the dummy load circuit 46 and the liquid drop ejecting head 45 electrically. After the head unit 47 is mounted, the control section 18 drives the motor 12 so as to scan the head unit 6 in the X direction; thus, the driving waveform COM is supplied to the head unit 47 via the dummy load circuit; thus, the liquid drop is ejected on the workpiece (substrate) W (driving step).

In the present embodiment, the head unit 47 is exchanged. Therefore, such an operation is not appropriate for an operation in which the first functional liquid D1 to the third functional liquid D3 shown in FIGS. 3 and 4 are ejected continuously while switching the liquid drop ejecting heads. However, for example, it is possible to eject the liquid drop stably in a manufacturing process for a device such as a micro-lens array in which the liquid drop ejecting head is not replaced.

Figure 8:
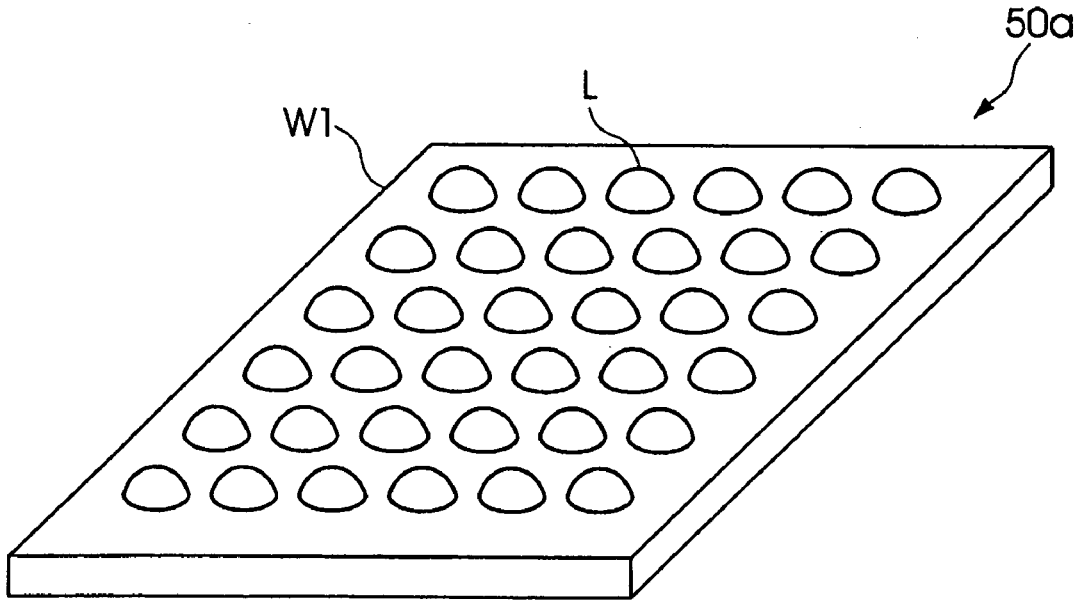
FIG. 8 is a view of a micro-lens array in an optical interconnection device which is manufactured by using a liquid drop ejecting device according to an embodiment of the present invention.
Figure 9:
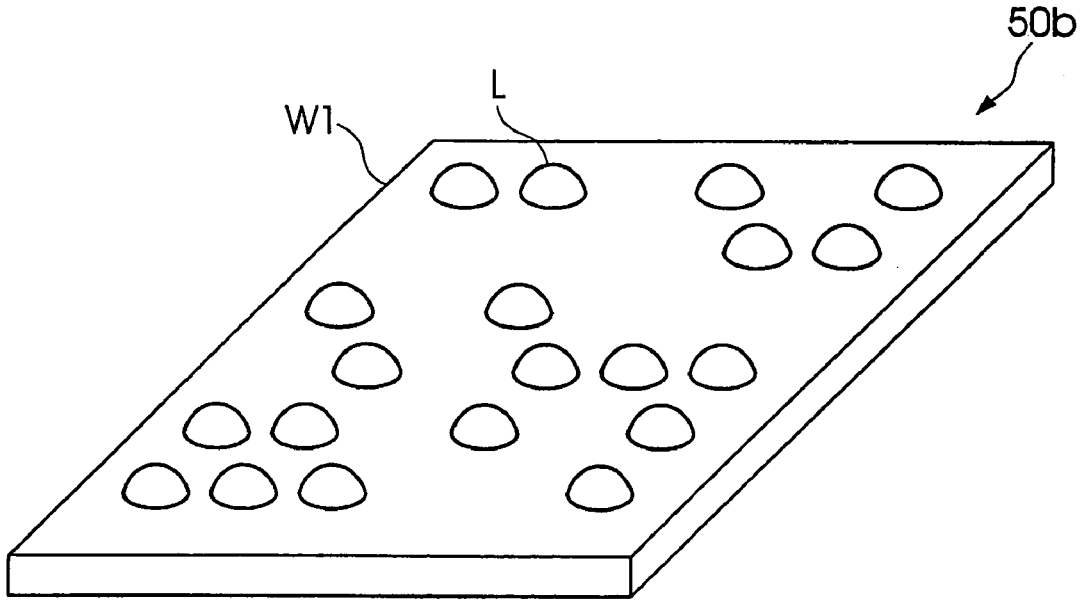
FIG. 9 is a view of a micro-lens array in an optical interconnection device which is manufactured by using a liquid drop ejecting device according to an embodiment of the present invention.

Layer Forming Device and a Method for Manufacturing Therefor, a Method for Manufacturing Device, and Electronic Apparatus The liquid drop ejecting device according to the embodiments of the present invention are explained as above. Such a liquid drop ejecting device can be used for devices such as a layer forming device for forming a layer or a micro-lens array, a liquid crystal display device, an organic EL (Electro-Luminescence) device, a plasma display device, a FED (Field Emission Display) device. FIGS. 8 and 9 are views of a micro-lens array in an optical interconnection device which is manufactured by using a liquid drop ejecting device according to an embodiment of the present invention respectively. In the liquid drop ejecting device, it is possible to manufacture micro-lens arrays 50*a* and 50*b* for an optical interconnection device by ejecting a photosensitive transparent resin (viscous liquid material) to a predetermined position on an object W1 which is made of a transparent substrate from the liquid drop ejecting head as shown in FIGS. 8 and 9 and by hardening the photosensitive transparent resin so as to form a micro-lens L having a predetermined area in a predetermined position on the transparent substrate.

Here, in the micro-lens array 50*a* shown in FIG. 8, the micro-lens L is disposed in the X direction and Y direction in a matrix manner. Also, in the micro-lens array 50*b* shown in FIG. 9, the micro-lens L is disposed in the X direction and Y direction in a non-uniform dispersed manner. Here, the micro-lens array is used for not only for an optical interconnection device but also for a liquid crystal panel. When an ink jet device which employs the present invention is used for manufacturing a micro-lens for the liquid crystal device, it is not necessary to use a photo-lithography technique; therefore, it is possible to improve manufacturing efficiency for the micro-lens array.

Figure 10:
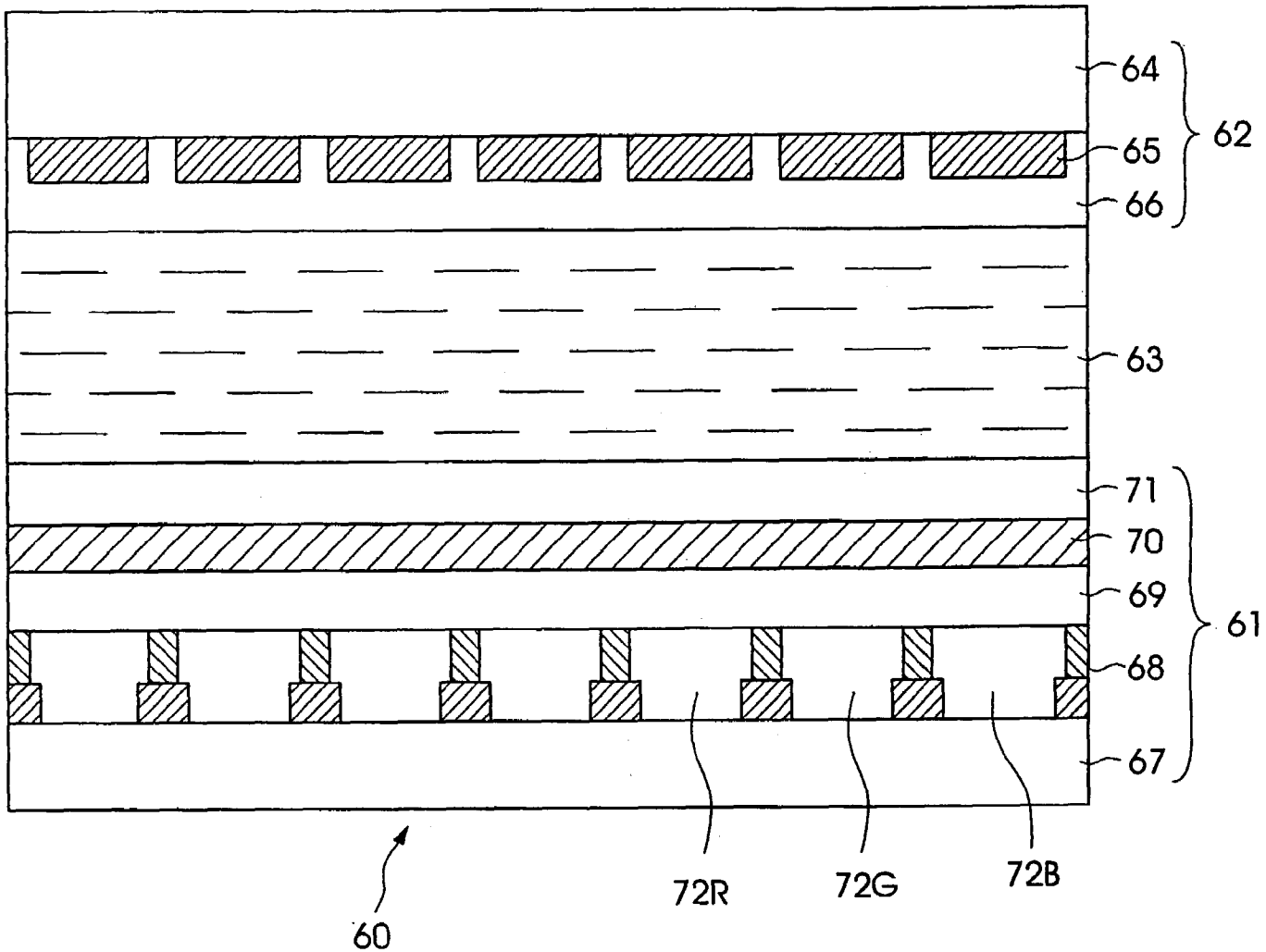
FIG. 10 is a cross section showing a general structure of a liquid crystal device which uses a color filter substrate which is manufactured by the liquid drop ejecting device according to an embodiment of the present invention.
Figure 11A:
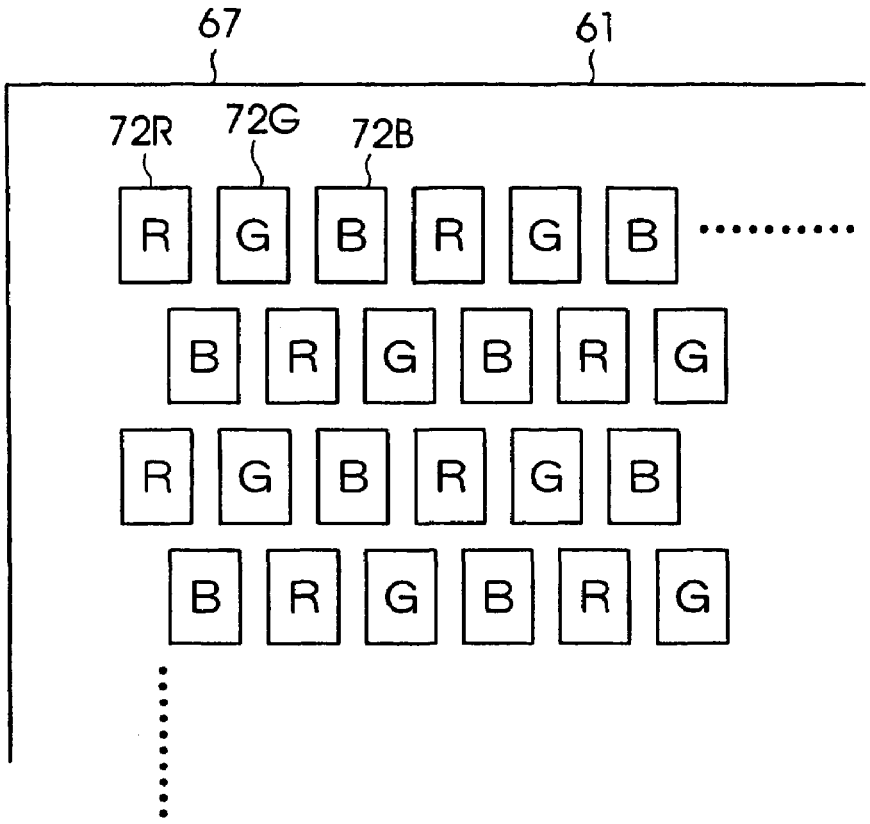
FIGS. 11A and 11B are views for showing a disposition of colors on the color filer substrate.
Figure 11B:
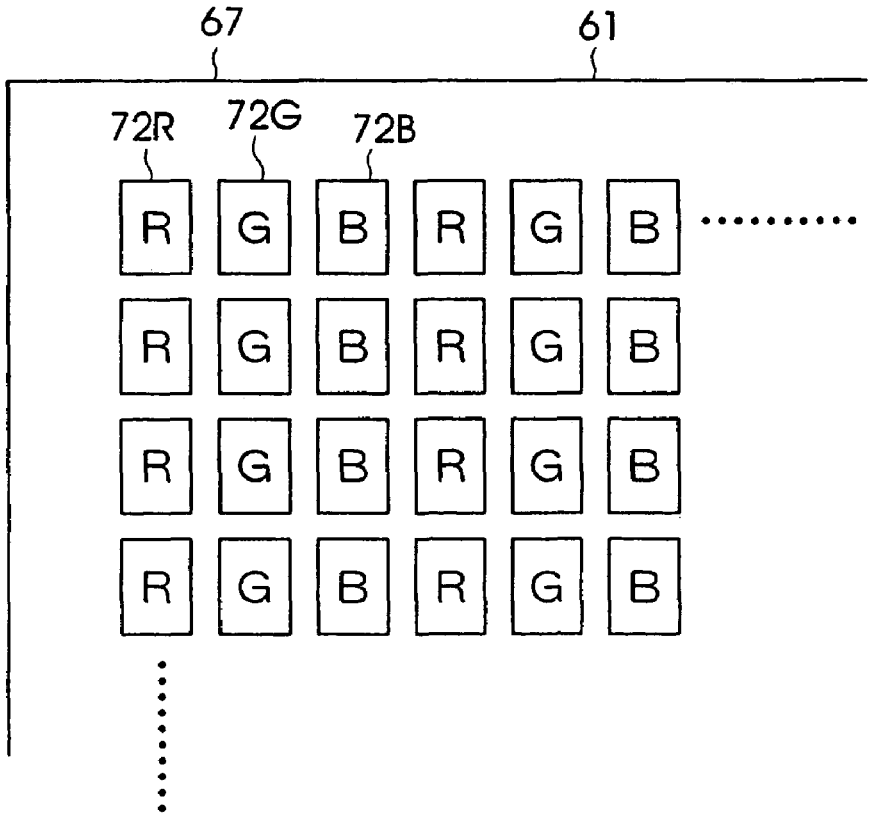

FIG. 10 is a cross section showing a general structure of a liquid crystal device which uses a color filter substrate which is manufactured by the liquid drop ejecting device according to an embodiment of the present invention. FIGS. 11A and 11B are views for showing a disposition of colors on the color filter substrate. In FIG. 10, in the liquid crystal device 60, for example, the color filter 61 and the TFT array substrate 62 are cemented together such that a predetermined space is formed therebetween, and a liquid crystal 63 is sealed as an electro-optical material between these substrates. In the TFT array substrate 62, a TFT (not shown in the drawing) for a pixel switching operation and a pixel electrode 65 are disposed on an inner surface of the transparent substrate 64 in a matrix manner. A disposed layer 66 is formed on a surface of the inner surface of the transparent substrate 64. In contrast, in the color filter substrate 61, color filter layers for R (red), G (green), and B (blue) 72R, 72G, and 72B, respectively, are formed on the transparent substrate 64 so as to face the pixel electrode 65. A flattening layer 69, a facing electrode 70, and a deposition layer 71 are formed on a surface of the transparent substrate 64.

In the color filter substrate 61, the color filter layers 72R, 72G, and 72B are surrounded by a bank 68 having a one-step section or two-step section. That is, the color filter layers 72R, 72G, and 72B are formed inside of the bank 68. Here, the color filter layers 72R, 72G, and 72B are disposed in a predetermined disposition such as a delta disposition shown in FIG. 11A or a stripe disposition shown in FIG. 11B.

The color filter substrate 61 having such a structure is manufactured as follows. That is, first, a bank 68 is formed on a surface of the transparent substrate 67. After that, a resin (viscous liquid material) having a predetermined color is supplied in each bank 68 by using the liquid drop ejecting device according to the first to third embodiments. The resin having a predetermined color is cured by an ultra-violet ray or a heat so as to form the color filter layers 72R, 72G, and 72B. Therefore, it is possible to form the color filter layers 72R, 72G, and 72B without using a photo-lithographic technology; thus, it is possible to improve a manufacturing efficiency for the color filter substrate 61.

Figure 12:
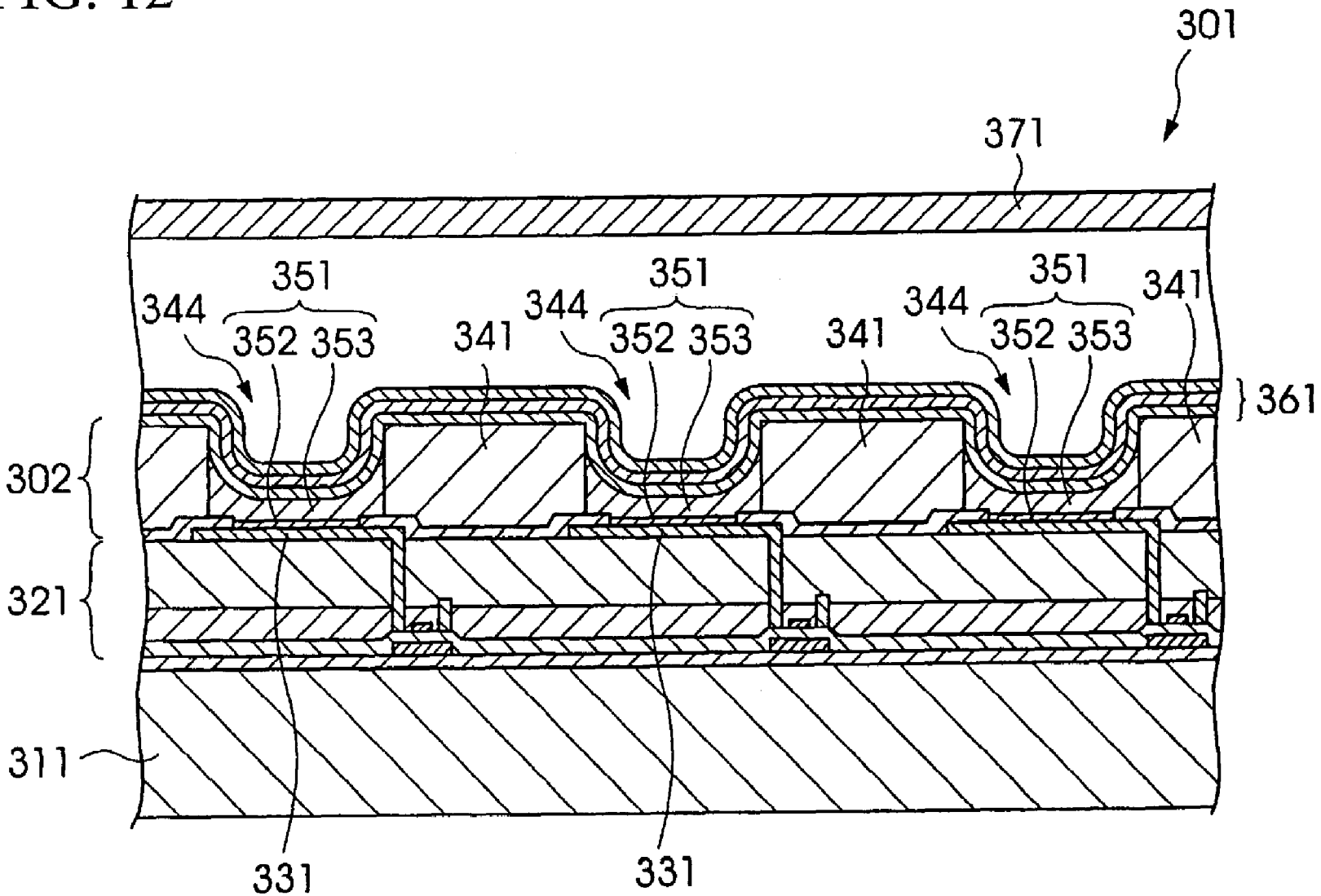
FIG. 12 is a cross section of an example for an organic EL device.

FIG. 12 is a cross section of an example for an organic EL device. As shown in FIG. 12, an organic EL device 301 is formed in which a wiring on a flexible substrate (not shown in the drawing) and a driving IC (Integrated Circuit, not shown in the drawing) are connected to an organic EL element 302 which comprises a substrate 311, a circuit element section 321, a plurality of pixel electrodes 331, a plurality of bank sections 341, a plurality of illuminating elements 351, a cathode 361 (facing electrode), and a sealing substrate 371. The circuit element section 321 is formed on the substrate 311. A plurality of pixel elements 331 are disposed in arrays on the circuit element section 321. In addition, each bank section 341 is formed in a lattice manner between the pixel electrodes 331. Each illuminating elements 351 are formed in concave aperture sections 344 which are formed by the bank sections 341.

A manufacturing process for an organic EL device 301 which including an organic EL element comprises the steps for forming a bank sections 341, performing a plasma processing operation for forming the illuminating elements 351 appropriately, forming illuminating elements 351, forming a cathode (facing electrode) 361, and sealing the cathode 361 by layering the sealing substrate 371.

In a step for forming the illuminating elements, positive hole implanting/transporting layers 352 and illuminating layers 353 are formed on the concave aperture sections 344, that is, on pixel electrodes 331. The step for forming the illuminating elements has a step for forming the positive hole implanting/transporting layers and a step for forming the illuminating layer. Furthermore, a step for forming the positive hole implanting/transporting layers has a step for ejecting a first component (functional liquid) on each pixel electrode 331 for forming the positive hole implanting/transporting layers 352 and a first drying step for drying the ejected first component so as to form the positive hole implanting/transporting layers 352. Also, the step for forming the illuminating layer has a step for ejecting a second component (functional liquid) on the positive hole implanting/transporting layers 352 for forming the illuminating layer 353 and a second drying step for drying the ejected second component so as to form the illuminating layers 353. In the step for forming the illuminating elements, the above illuminating elements are formed by using the liquid drop ejecting device.

Figure 13:
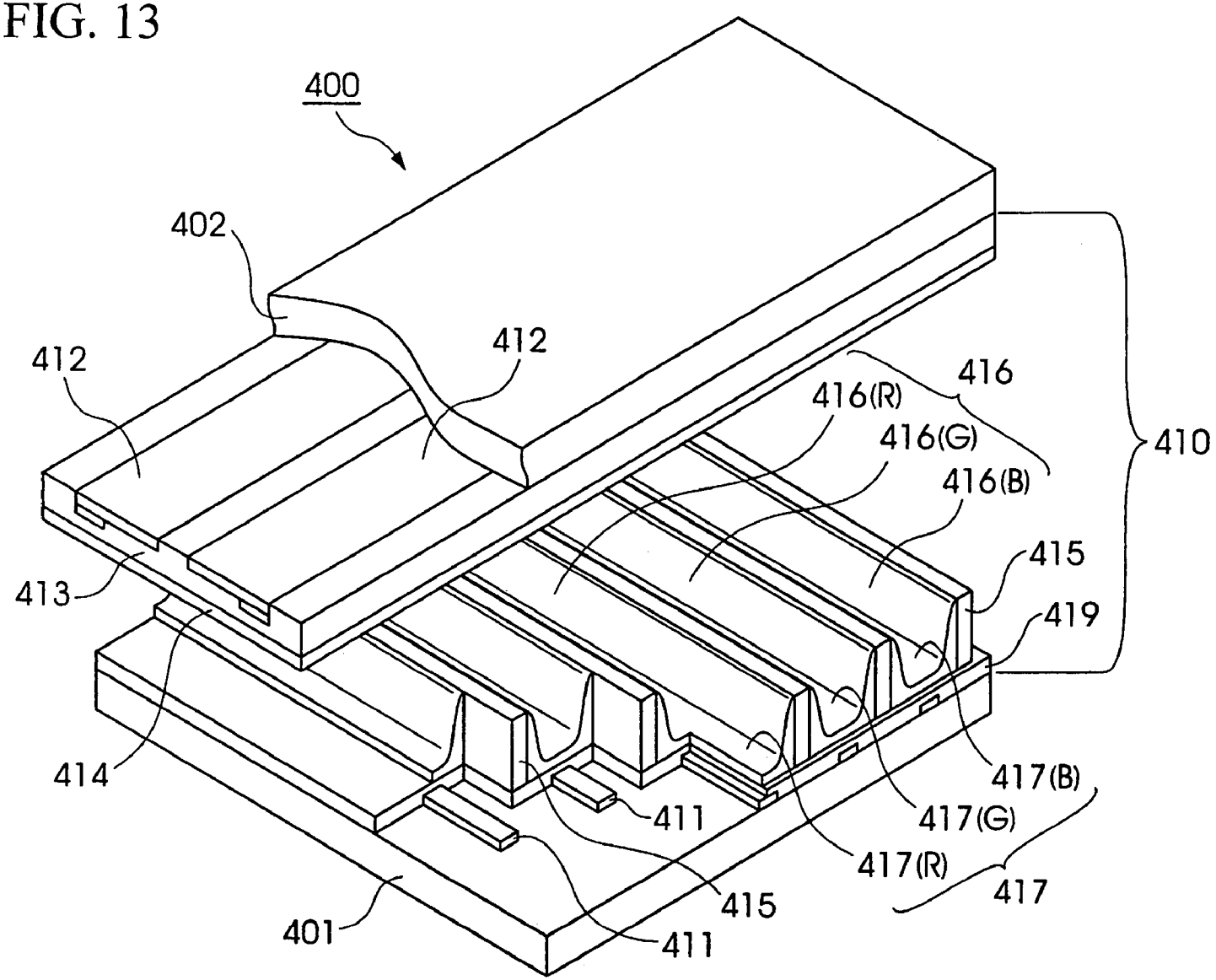
FIG. 13 is an isometric view of a part of a plasma display device.

FIG. 13 is an isometric view of a part of a plasma display device. As shown in FIG. 13, a plasma display device 400 comprises substrates 401 and 402 which are disposed so as to face each other, and a discharging display section 410 which is formed between the substrates 401 and 402. The discharging display device 410 is formed by a plurality of discharging chambers 416 collectively. Plural discharging chambers 416 forms a pixel such that three colors of discharging chambers such as a red color discharging chamber 416(R), a green color discharging chamber 416(G), and a blue color discharging chamber 416(B) form a unit.

A plurality of address electrodes 411 are formed on an upper surface the substrate 401 in a stripe manner with a predetermined interval from each other. A dielectric layer 419 is formed so as to cover upper surfaces of the address electrodes 411 and upper surface of the substrate 401. On the dielectric layer 419, a plurality of separation walls 415 are formed so as to be disposed between the address electrodes 411 and 411 along each address electrodes 411. A separation wall 415 includes a separation wall which neighbors both sides in the width direction of the address electrodes 411 horizontally and a separation wall which expands in a direction orthogonal to the address electrodes 411. Also, the discharging chambers 416 are formed so as to correspond to a rectangular area which is formed by the separation walls 415. Fluorescent materials 417 emit either one of fluorescent light among red, green, or blue. A red color fluorescent material 417 (R) is disposed on a bottom surface of the red color discharging chamber 416 (R). A green color fluorescent material 417 (G) is disposed on a bottom surface of the green color discharging chamber 416 (G). Also, a blue color fluorescent material 417 (B) is disposed on a bottom surface of the blue color discharging chamber 416 (B).

A plurality of display electrodes 412 are formed on the substrate 402 in a stripe manner with predetermined intervals in a direction orthogonal to the above address electrodes 411. Furthermore, a protection layer 414 which is made from the dielectric layer 413 and an oxides such as MgO is formed so as to cover the display electrodes 412. The substrate 401 and the substrate 402 are cemented together so as to face each other such that the address electrodes 411 and the display electrodes 412 are disposed so as to be orthogonal to each other. The address electrodes 411 and the display electrodes 412 are connected to an alternative current power supply, which is not shown in the drawing. Electricity is supplied to each electrode; thus, the fluorescent material 417 is excited and emits light in the discharging display section 410. By doing this, it is possible to perform a color display operation. The liquid drop ejecting device according to the present embodiment of the present invention is used for disposing a fluorescent material 417 inside of the rectangular area which is separated by the separation walls 415.

Figure 14B:
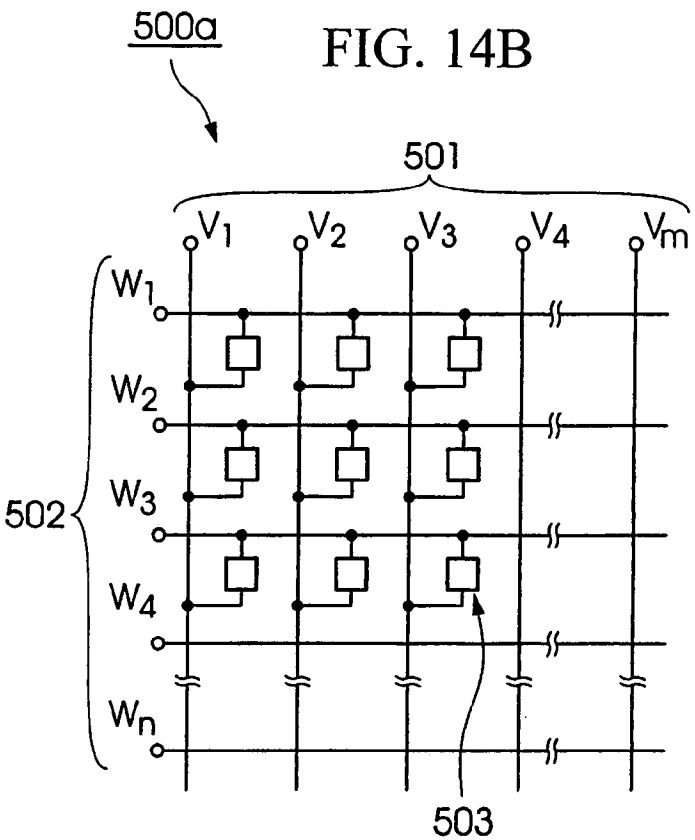
FIGS. 14A to 14C are views showing a field emission display which is provided with field emission elements.
Figure 14A:
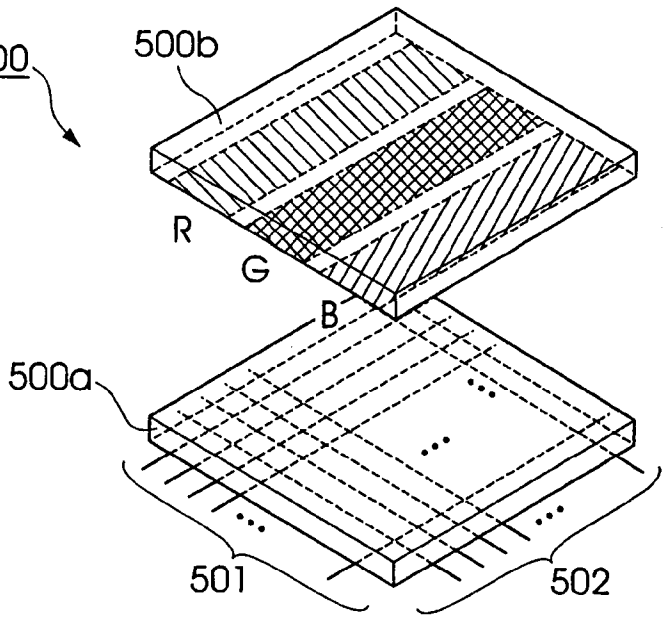
Figure 14C:
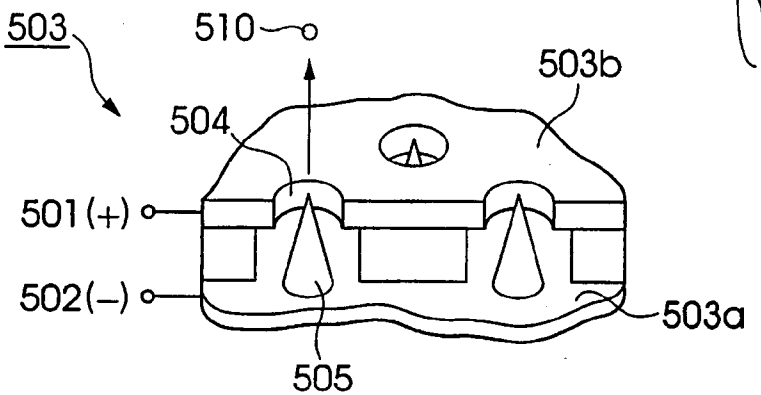

FIGS. 14A to 14C are views showing a field emission display (FED) which is provided with field emission elements. FIG. 14A is an isometric view showing a general disposition of a cathode substrate and an anode substrate which form the FED. FIG. 14B is a circuit diagram showing a general structure of a driving circuit which is disposed in the cathode substrate in the FED. FIG. 14C is an isometric view showing an important part of the cathode substrate. As shown in FIG. 14C, in an FED 500, the cathode substrate 500*a* and an anode substrate 500*b* are disposed so as to face each other.

As shown in FIGS. 14A and 14B, the cathode substrate 500*a* comprises a plurality of gate lines 501, a plurality of emitter lines 502, and a simple matrix circuit which is provided with a polarity of field emission elements 503 which are connected to the gate lines 501 and the emitter lines 502. Gate signals $V_1, V_2, \ldots, V_m$ are supplied to the gate lines 501. Emitter signals $W_1, W_2, \ldots, W_n$ are supplied to the emitter lines 502. Also, the anode substrate 500*b* is provided with a fluorescent material which has a light emitting characteristics when an electron contacts thereto. For such a fluorescent material, a fluorescent material which emits either one of color fluorescent lights among red, green, or blue is used.

As shown in FIG. 14C, the field emission element 503 comprises an emitter electrode 503*a* which is connected to the emitter line 502 and a gate electrode 503*b* which is connected to the gate line 501. Also, the emitter electrode 503*a* is provided with a protruding section which is called an emitter tip 505 of which the diameter of the tip becomes smaller gradually in a direction from the emitter electrode 503*a* to the gate electrode 503*b*. A hole section 504 is formed in a corresponding position to the emitter tip 505 on the gate electrode 503*b*. The tip of the emitter tip 505 is disposed in the hole section 504.

When a voltage is supplied between the emitter electrode 503*a* and the gate electrode 503*b* which are disposed in the field emission element 503, an electron 510 moves from the emitter tip 505 toward the hole section 504 because of an electric field; thus, the electron 510 is discharged from the tip of the emitter tip 505. The fluorescent material emits a light when the discharged electron 510 contacts the fluorescent material on the anode substrate 500*b* which is disposed so as to face the cathode substrate 500*a*. Therefore, it is possible to display a desirable color by controlling the gate signals $V_1, V_2, \ldots, V_m$ in the gate lines 501 and the emitter signals $W_1, W_2, \ldots, W_n$ in the emitter lines 502 and driving the FED 500. The liquid drop ejecting device according to the present embodiment of the present invention is used for disposing the fluorescent material on the anode substrate 500*b*.

The above devices such as a liquid crystal device, an organic EL device, a plasma display device, and an FED are disposed in an electronic apparatus such as a notebook computer and a mobile phone. However, the electronic devices according to the present invention can be used not only for the above notebook computer and the mobile phone, but also for various electronic apparatuses such as a liquid crystal projector, a multi-media personal computer (PC) and an engineering work-station (EWS), a pager, a word processor, a television, a video tape recorder having a view finder or a direct monitor, an electronic organizer, electronic desktop calculator, a car navigation system, a POS (Point of Sale) terminal, and devices which are provided with a touch panel.

The entire disclosure of Japanese Patent Application Nos. 2002-265736 filed Sep. 11, 2002 and 2003-285988 filed Aug. 4, 2003 are incorporated by reference.

What is claimed is:

1. A liquid drop ejecting device for ejecting a liquid drop to a workpiece, comprising:

a plurality of liquid drop ejecting heads;

a plurality of control sections which are provided with circuits for restricting an oscillation of a driving waveform which is applied to the liquid drop ejecting heads; and a selecting section which selects either one of the plurality of control sections according to a liquid drop which is ejected from the liquid drop ejecting heads, wherein the driving waveform is applied to the liquid drop ejecting heads via the control section which is selected by the selecting section, wherein the selecting section is provided with plural mechanical switches for switching an electric connection condition between the control section and the liquid drop ejecting heads, and wherein the control sections are provided with plural liquid drop ejecting heads having different specifications from each other.

2. A liquid drop ejecting device according to claim 1 wherein:

the selecting section is provided with plural electric switches which are connected to the control section and the liquid drop ejecting head; and the selecting section selects any one of the plural control sections which are connected to the liquid drop ejecting heads by switching a connection of the electric switch.

3. A liquid drop ejecting device according to claim 2 wherein the electric switch is an analogue switch.

4. A liquid drop ejecting device according to claim 1 wherein the mechanical switch is a DIP switch which is operated by a user.

5. A liquid drop ejecting device according to claim 1 comprising:

a carriage on which various liquid drop ejecting heads are mounted;

a functional liquid supplying structure which supplies functional liquids to the various liquid drop ejecting heads;

a moving structure which moves the various liquid drop ejecting heads via the carriage relative to the workpiece; and an ejection driving control section which controls a ejection driving operation in either one of the liquid drop ejecting heads so as to synchronize the moving structure.

6. A layer forming method comprising the step for forming a layer by ejecting a liquid drop by the liquid drop ejecting device according to claim 1.

7. A method for manufacturing a device which is provided with a workpiece in which functional patterns are formed in predetermined sections therein comprising the step for forming the functional patterns in the workpiece by ejecting the liquid drop by the liquid drop ejecting device according to claim 1.

8. An electronic apparatus which is provided with a device which is manufactured by the liquid drop ejecting device according to claim 1.

9. A liquid drop ejecting device for ejecting a liquid drop to a workpiece comprising:

a plurality of liquid drop ejecting heads having different specifications from each other;

a plurality of head units which are exchangeable reciprocally and provided with the liquid drop ejecting heads;

a driving device which drives the liquid drop ejecting heads; and a plurality of control sections which are disposed on each head unit, wherein the control sections have a circuit for restricting an oscillation of a driving waveform, and wherein the circuit is selected according to an electric characteristic in the liquid drop ejecting head.

10. A liquid drop ejecting device according to claim 9 wherein the control section contains an electric resistance element and an electric capacity element.

11. A layer forming device which is provided with the liquid drop ejecting device according to claim 10.

12. A method for ejecting a liquid drop to a workpiece comprising the steps of:

selecting a liquid drop ejecting head which should be driven among plural liquid drop ejecting heads having different specifications from each other;

selecting a control section among a plurality of control sections which have circuits for restricting an oscillation of the driving waveform which is applied to the liquid drop ejecting heads according to the liquid drop which is ejected from the liquid drop ejecting heads; and supplying a driving signal to the liquid drop ejecting head which is selected in the step for selecting the liquid drop ejecting head via the control section which is selected in the step for selecting the control section so as to eject the liquid drop.

13. A layer forming method comprising the step for forming a layer by ejecting a liquid drop by the liquid drop ejecting device according to claim 12.

14. A method for manufacturing a device which is provided with a workpiece in which functional patterns are formed in predetermined sections therein comprising the step for forming the functional patterns in the workpiece by ejecting the liquid drop by the liquid drop ejecting device according to claim 12.

15. An electronic apparatus which is provided with a device which is manufactured by the liquid drop ejecting device according to claim 12.

16. A method for ejecting a liquid drop to a workpiece comprising the steps of:

mounting a head unit which is provided with a liquid drop ejecting head and a control section for restricting an oscillation of a waveform which is applied to a liquid drop ejecting head according to an electric condition of the liquid drop ejecting head; and supplying a driving signal to the liquid drop ejecting head via the control section which is disposed in the head unit which is mounted in the step for mounting a head unit so as to eject the liquid drop.

* * * * *

UNITED STATES PATENT AND TRADEMARK OFFICE

CERTIFICATE OF CORRECTION

PATENT NO. : 7,052,099 B2
APPLICATION NO. : 10/658108
DATED : May 30, 2006
INVENTOR(S) : Hidenori Usuda et al.

It is certified that error appears in the above-identified patent and that said Letters Patent is hereby corrected as shown below:

On Title Page
Title Page, Item (54) Title, Line 4, After "Manufacturing" insert -- Method --.
Title Page, Item (75) Inventors: Residence of Yutaka Takano: "Ashi-mura (JP)" should be -- Asahi-mura (JP) --.
Col. 1, line 4: after "Manufacturing" insert -- Method --.
Col. 1, line 52: "which" should be -- with --.
Col. 2, line 65: "a" should be -- an --.
Col. 3, line 34: after "specification" insert -- from --.
Col. 4, line 51: "filer" should be -- filter --.
Col. 8, line 48: delete second occurrence of "the first to third".
Col. 8, line 50: delete second occurrence of "the first to third".
Col. 11, line 18: delete "a".
Col. 14, line 49: after "surface" insert -- of --.
Col. 15, line 7: "oxides" should be -- oxide --.
Col. 15, line 41: delete "a".

Signed and Sealed this

Twenty-fourth Day of April, 2007

JON W. DUDAS
*Director of the United States Patent and Trademark Office*